US007128639B2

(12) United States Patent
Riedle et al.

(10) Patent No.: US 7,128,639 B2
(45) Date of Patent: Oct. 31, 2006

(54) PROCESS AND APPARATUS FOR THE ARTIFICIAL AGING OF STONES

(76) Inventors: Thomas Riedle, Neue-Welt-Strasse 18, 88319 Aitrach (DE); Hermann Sauter, Robert-Bosch-Strasse 11, 88459 Tannheim (DE)

( * ) Notice: Subject to any disclaimer, the term of this patent is extended or adjusted under 35 U.S.C. 154(b) by 0 days.

(21) Appl. No.: 11/023,989

(22) Filed: Dec. 28, 2004

(65) Prior Publication Data

US 2005/0229913 A1 Oct. 20, 2005

(51) Int. Cl.
*B24B 1/00* (2006.01)
*B24B 31/00* (2006.01)
*B28D 1/26* (2006.01)

(52) U.S. Cl. ..... 451/32; 451/326; 451/35; 125/40

(58) Field of Classification Search ..... 451/32, 451/326, 35, 330; 125/1, 40
See application file for complete search history.

(56) References Cited

U.S. PATENT DOCUMENTS 6,279,291 B1 * 8/2001 Geusens et al. ..... 52/741.1

FOREIGN PATENT DOCUMENTS

| | | | |
|---|---|---|---|
| DE | 29 22 393 | | 12/1979 |
| DE | 3621276 | A1 | 1/1988 |
| DE | 10307447 | * | 9/2004 |
| DE | 10333213 | A1 * | 2/2005 |
| EP | 0 860 258 | A1 | 2/1998 |
| FR | 002794397 | A1 * | 12/2000 |

* cited by examiner

*Primary Examiner*—Eileen P. Morgan
(74) *Attorney, Agent, or Firm*—Collard & Roe, P.C.

(57) ABSTRACT

A process for the artificial aging of stones, particularly concrete blocks, clinker blocks and natural stones, provides for the stones to be applied to a support. Impact units that move essentially freely are applied to the surface of the stones that is to be processed. The stones and the impact units are set in motion in relation to each other by vibration of the support in such a way that the impact units act on the surface and the adjacent, exposed edges of the stones.

22 Claims, 2 Drawing Sheets

PROCESS AND APPARATUS FOR THE ARTIFICIAL AGING OF STONES

CROSS REFERENCE TO RELATED APPLICATIONS

Applicants claim priority under 35 U.S.C. §119 of German Application No. 103 61 732.9 filed Dec. 29, 2003

The invention relates to a process for the artificial ageing of stones, particularly concrete blocks, clinker blocks and natural stones. The present invention also relates to an apparatus for the artificial ageing of stones.

Stones such as flooring elements, cladding panels, sand-lime bricks, concrete blocks, clay bricks and/or clinker blocks, natural stones etc., are frequently subjected to subsequent treatment—irrespective of their material structure—in order to reduce or conceal their artificial appearance as a result.

Freshly produced, cemented concrete blocks, especially concrete paving stones, are subjected to subsequent treatment of this kind particularly frequently, in the course of which the surfaces and/or the edges are knocked (off) and/or broken, in order to match their appearance to natural stones. To do this, large numbers of the concrete blocks are loaded in a rotary drum, in which they revolve and the surfaces and edges of the stones knock against each other, so that the stones treated in this way leave the drum in an "aged" condition. Such an apparatus has been disclosed in DE-OS 29 22 393.

When the concrete blocks are processed in a rotary drum, surfaces and edges are also processed that are not even visible when the aged stones are used as paving stones, for example. Unnecessary energy and time are therefore wasted. It is also necessary to load the concrete blocks that leave the rotary drum after treatment on a pallet in a regular pattern for shipment purposes, which requires a disproportionately large amount of work and time.

An alternative process to the rotary drum has been disclosed in the prior art, in which the stones that have to be aged are loaded onto a sloping trough together with a large number of impact units. This trough is vibrated, so that the stones knock against each other and the impact units. This gives the stones an aged look that corresponds to a large extent to the results of the rotary drum process outlined above. Due to the fact that the trough slopes, the stones which have to be processed and the impact units move from a top end to a bottom end of the trough. After the stones and the impact units have left the trough at the bottom end, the impact units are separated from the stones. The impact units are fed back into the top end of the trough, while the stones are transported on to a sorting facility.

Sorting facilities designed to sort the stones have been disclosed in the prior art that align the stones appropriately and arrange them in pallet form. Such sorting facilities cause high investment and operating costs and require a considerable amount of space too.

DE 36 21 276 C2 discloses a process in which concrete blocks are put on a plate-like support in a single, regularly arranged layer. The exposed surface and the adjacent exposed edges or essentially only the edges of the concrete blocks are then knocked irregularly by a vibrating knocking or hitting unit.

This process makes it possible to do without a subsequent sorting facility, because the batch that is produced is not changed. Before they are processed by the knocking or hitting units, the stones are pushed together on the plate-like support and are aligned, so that the stones fit snugly next to each other and there are no longer any gaps between them. The impact tools of the impact unit are provided on a moving carriage, which guides them over the surfaces of the stones, so that the exposed surfaces and the top edges of the stones are knocked irregularly by the impact tools.

It is, however, a disadvantage in this process that the stones aged in this way are processed artificially and do not look as if they have aged naturally. The stones are not given the ideally broken edges they have after the stones have revolved in a rotary drum when the process in accordance with the relevant disclosure is used.

EP 0 860 258 B2 discloses an apparatus and a process in which preferably one batch of the stones that have been produced is located between two elements, preferably plates, in one or two layers. The lower plate, on which the concrete blocks are resting, engages a vibration mechanism in this context. The vibration mechanism sets the stones in motion, so that they move backwards and forwards between the plates. The stones knock against each other as well as against the upper and lower plate in this operation, as a result of which the edges on the top and bottom are broken. The upper and lower surfaces of the stones are also hit by the relevant plates. The vertical side edges of the concrete blocks and the side surfaces are broken and/or knocked by the adjacent concrete blocks in each case.

Trials have demonstrated that edge breakage deteriorates as the size of the stone being aged increases. This is due to the fact that the flatness of the impact angle increases with the size of the stone between the plates. The flat impact angle leads to unfavourable breakage of the edges. As is the case with the ageing process using the rotary drum, the disadvantage here is that surfaces and edges of the stones are processed that may not even be visible, as a result of which unnecessary energy and time is wasted. The time taken to complete the processing operation is high too, particularly with cemented concrete blocks, and edge breakage is not ideal.

The purpose of the present invention is therefore to propose a process and an apparatus for the artificial ageing of stones, particularly concrete blocks, clinker blocks and natural stones, with which energy and time are saved in the ageing operation and advantageous edge breakage is achieved.

As far as the process for doing this is concerned, this assignment is carried out by the features of claim 1.

As far as the apparatus for doing this is concerned, this assignment is carried out by the features of claim 12.

The inventors made the surprising discovery that the top surface of the stones and the adjacent exposed edges of them are aged quickly and effectively by the solution in accordance with the present invention. The vibrating movement of the support makes sure that the impact units and, to a lesser extent, the stones as well are set in motion.

The strength of the movement of the stones and the impact units depends on the vibration and the number of stones and impact units as well as their weight. The impact units lift off the surface of the stones on which they are resting simply in this process. The impact units then drop back onto the surface of the stones under the influence of gravity, hitting them and/or having an "ageing" effect on them. The stones are hit irregularly as a result of the fact that the impact units lift off randomly and drop back onto the stones randomly too. A look similar to naturally aged stone is created in this way.

The inventors discovered that the impact units act particularly effectively on the edges of the stones, so that they are broken as required and are thus given an aged appearance within the shortest possible time.

It can be advantageous in this context if the stones are given a certain amount of freedom that permits lateral movement of the stones, so that the edges of the stones can take up positions a distance away from each other. What is important in this context is not that this gap (caused by the vibration) enables the edges of the stones to knock against each other, but that the impact units can engage the gap between two edges particularly effectively and thus break the edges in a visually advantageous way. It is possible in principle to break and/or process the edges without such a gap too.

It is an advantage if the space available for the stones to move laterally is less than the minimum diameter of the impact units.

This makes sure that the impact units cannot enter the gap between two edges of two adjacent stones. If the impact units have a minimum diameter of, say, 5 cm, it can be provided that the total space available for the stones to move laterally amounts to 4 cm. The solution in accordance with the present invention is not limited to the simultaneous ageing of a certain number of stones and/or one layer of stones. The concept "Apparatus and/or process for the artificial ageing of stones" can also be taken to mean that only one single stone is aged in accordance with the process and/or is fed into the apparatus.

The apparatus can, for example, be designed to take the form of a trough that the stones pass through individually or in one or more rows. The impact units engage the surface of the stones in at least one section of the trough in this process. The trough can be linked to a vibration mechanism, for example with unbalance generators that cause the trough to start vibrating. The vibrating movement is transferred to the impact units via the stones, with the result that the latter lift off the surface of the stones and drop back onto them again with appropriate impact. It is preferable for the sides of the trough to be designed in such a way that a lateral stop is created for the stones and for the impact units, so that not only the stones but also the impact units are enclosed and cannot leave the trough.

The stones can be loaded onto and removed again from the trough in any way. It is also possible to provide the trough with a conveyor belt.

It is an advantage if the stones are aged in the batch in which they have been produced. The stones can be put on the preferably plate-like support in a single layer in the batch in which they are produced if this is the case. The general state of the art offers a large number of possibilities for doing this. The impact units then engage the surface of the stones, while the support starts to vibrate subsequently or already before the impact units engage the stones. A complete batch of stones can therefore be aged in a minimum of time and with a minimum of energy in this way after they have been produced. The results correspond at least to the results achieved with stones aged in a rotary drum.

Subsequent sorting of the stones is not necessary in the process proposed by the present invention.

In an advantageous configuration, it can be provided that the support has a rim, by which the loaded stones are restricted in their lateral movement. It is advantageous in this context if the rim encloses the stones with a certain amount of play, so that the stones can take up positions a distance away from each other, allowing the impact units to engage the edges of two adjacent stones and/or of one stone and the rim. It is particularly advantageous in this context if the rim projects vertically beyond the surface of the stones, so that a lateral stop is formed for the impact units. The lateral stop restricts the movement of the impact units essentially to the surface of the stones.

After processing has been completed, it is simple to remove the impact units from the surface of the stones again. Various technical configurations are possible for this purpose.

It is an advantage if the impact units are made of hard metal, metal or steel and if the impact units are lifted off the surface magnetically after the surface and/or the edges of the stones have been processed. A magnet can, for example, be located above the surface of the stones for this purpose. It is preferable to choose the distance between the magnet and surface of the stones so that the impact units do not touch the magnet while the surface of the stones is being processed. It is preferable to magnetise the magnet by supplying appropriate current. It can also be provided in this context that the magnet is moved towards the impact units by a guiding mechanism to lift the impact units off the surface of the stones.

As an alternative or in addition to the magnet, it is also possible to provide an application and removal device that has a discharge element which can be guided over the surface of the stones to remove the impact units. Two opposite sides of the rim can be lowered or flapped away for this purpose, for instance, so that the discharge element can be introduced appropriately and the impact units can be pushed out.

The solution proposed by the present invention makes it possible to process the surface and/or the edges that form and/or enclose the visible side of the stones when they are installed later on. No energy and time is therefore wasted in the processing of edges or surfaces that are not even visible when the stones are subsequently used.

The ageing process can be carried out in an advantageous way with concrete blocks that have been produced relatively shortly beforehand too. Such freshly manufactured and therefore not yet sufficiently hardened concrete blocks cannot in general be processed by means of other processes and/or apparatuses, since—in the case of ageing in a rotary drum, for example—there is a high risk that the entire stone will break and/or a correspondingly high reject rate will have to be accepted or high additional costs will have to be incurred to bond the stones quickly.

The apparatus proposed by the invention makes it possible in an advantageous way to ensure that the production batch can be maintained, with the result that a time-consuming and expensive sorting facility is not required.

The support and/or the rim of the support can be adapted to the different dimensions and shapes that stone production batches can have. The support and/or the rim of the support can have a circular shape, for example, when concrete paving stones are being produced that are supposed to be laid in a circular pattern.

Advantageous further developments and configurations are disclosed in the other subordinate claims as well as in the embodiments outlined below on the basis of the principles illustrated in the drawings.

Stones of any kind, such as flooring elements, cladding panels, sand-lime bricks, concrete blocks, clay bricks and/or clinker blocks or natural stones, can be aged in accordance with the invention irrespective of their material structure. The ageing of stones 1 that are in the form of concrete blocks is explained below on the basis of the embodiments. It goes without saying that the invention is not restricted to these alternatives, however.

The production of concrete blocks 1, particularly concrete paving stones, has been disclosed to a sufficient extent in the past, so this is not covered in detail here. The concrete blocks 1 generally leave the production line in a batch, i.e. in an arrangement in which a large number of concrete blocks are located next to each other in a single layer. Such a batch is illustrated in FIGS. 1 to 5 by way of example.

Figure 1:
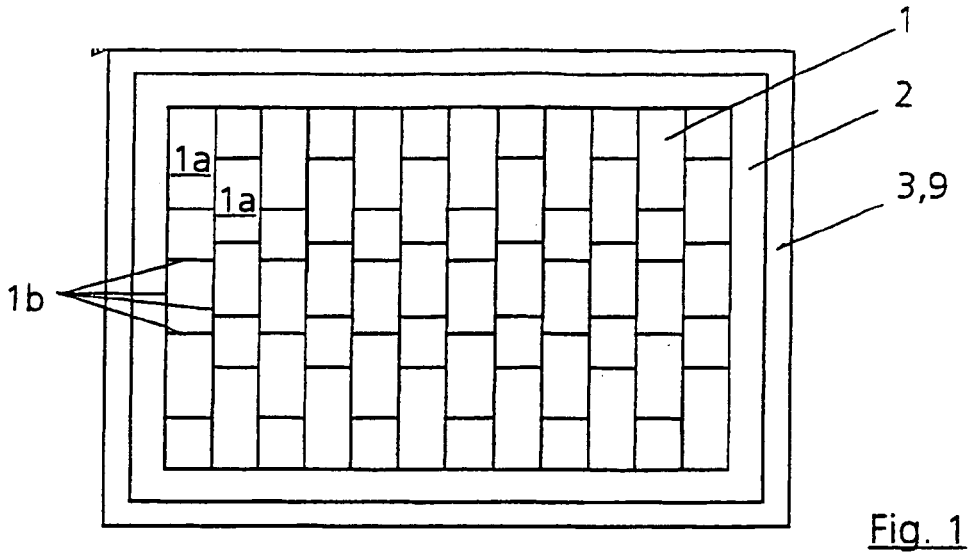
FIG. 1 is a top view of a batch of stones that have been produced and are provided with a support beneath them.

As can be seen in FIG. 1, the concrete blocks 1 have been provided in a regular, single-layer arrangement on a plate-like support 2. The concrete blocks 1 are arranged in such a way in this context that the edge 1*b* of the stone 1 that is to be processed and/or the surface 1*a* of the stone 1 that is to be processed (=normally the side that is visible later on) is facing upwards.

Figure 3:
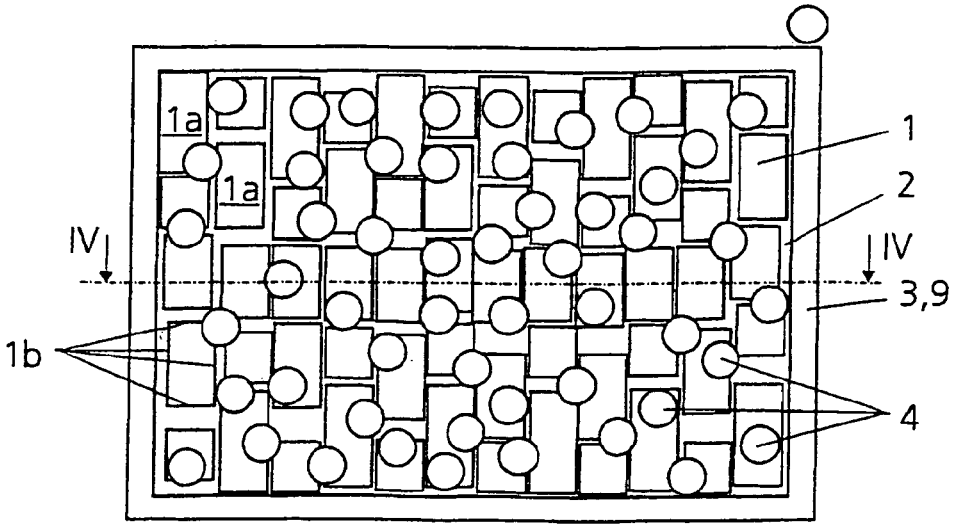
FIG. 3 is a view of the system illustrated in FIG. 2 when it is in operation, after the stones have taken up positions a distance away from each other because of the vibration of the support.

As can be seen in FIG. 1, the support 2 has a rim 3 that encloses the stones 1. The area of the support 2 enclosed by the rim 3 is larger than the area covered by the stones 1. This means that the stones 1 can take up positions a distance away from each other due to the vibration of the support 2. This is illustrated in FIG. 3.

Figure 2:
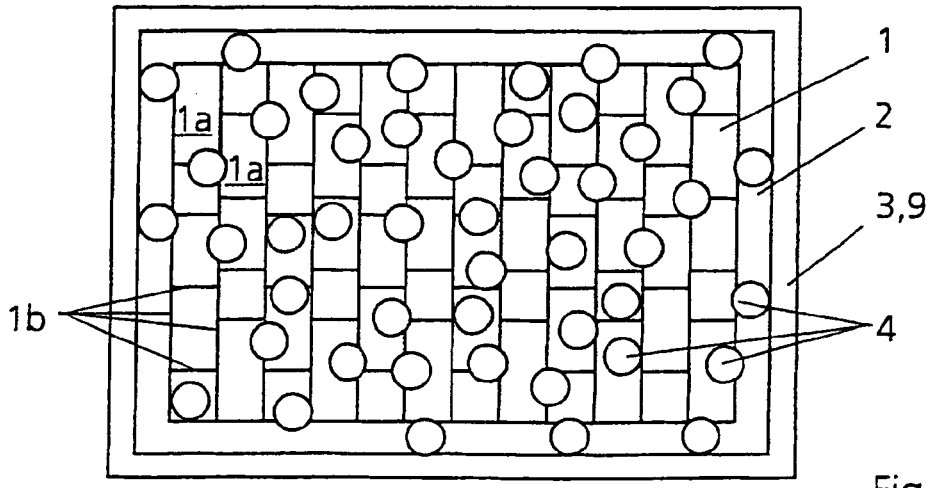
FIG. 2 is a top view of a batch of stones that have been produced and are provided with a support beneath them, where impact units have been applied to the surface of the stones.

FIG. 2 shows a number of impact units 4 that have been applied to and/or are resting on the surface 1*a* of the stones 1. The impact units 4 are designed to move freely in relation to the surface 1*a*. The impact units 4 are designed to move freely in relation to each other as well. The impact units 4 can be produced from any material. In this particular embodiment it is provided that the impact units are made from hard metal, metal or steel. The impact units 4 can be any shape too, although it has proved to be advantageous to give the impact units 4 a spherical, annular, polygonal or cylindrical shape. In the embodiment illustrated, the impact units 4 have a spherical shape.

An application and removal device 5 is provided in the embodiment illustrated in order to apply the impact units 4 to the surface 1*a* of the stones 1 and to remove them from the surface 1*a* of the stones again. Various configurations are conceivable here. The application and removal device 5 is designed as a magnet configuration in FIG. 4. By magnetising and demagnetising the magnet 5 appropriately, the impact units 4 are either attracted by the magnet 5 or are released by it to drop towards the surface 1*a* of the stones 1.

Figure 5:
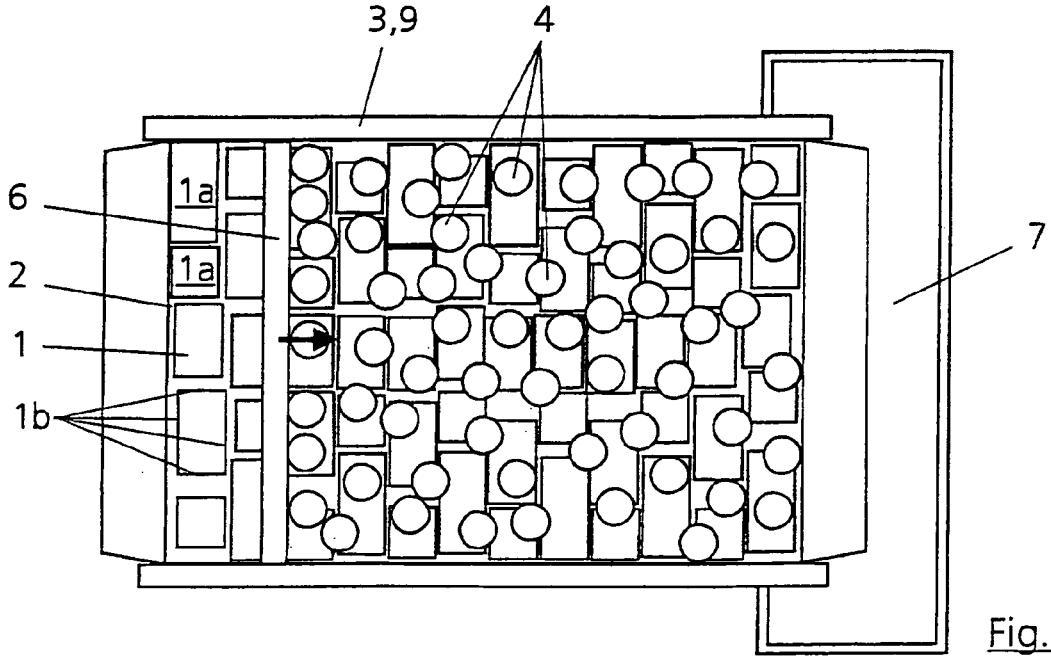
FIG. 5 is a top view of a batch of stones that have been produced after the ageing process has been completed, with a discharge element for removing the impact units from the surface of the stones.

FIG. 5 shows a different configuration of the application and removal device 5 with a discharge element 6, which pushes the impact units 4 off the surface 1*a* of the stones 1—for example by carrying out a linear movement—when the ageing process has been completed and discharges them into a collection container 7. The impact units 4 can be transported on by simple means from this collection container 7, so that the impact units 4 can be applied to a new layer of stones 1 that have been put on the support 2.

When the impact units 4 are resting on the surface 1*a* of the stones 1 in accordance with FIG. 2, the vibration operation and the ageing process itself begin. In a different configuration, it can also be provided that the vibration process is already in progress while the impact units 4 are being applied. FIG. 3 shows a possible pattern and/or arrangement of the stones 1 during the ageing process, i.e. while the support 2 is being vibrated. A vibration mechanism 8 of the kind illustrated, for example, in FIG. 4 can be used to produce the vibration. The vibration mechanism 8 can incorporate unbalance generators, for instance. The stones 1 and the impact units 4 are set in motion in relation to each other in such a way by the vibration mechanism 8 that the impact units 4 act on the surface 1*a* and the exposed edges 1*b* of the stones 1. The impact units 4 lift off the surface 1*a* of the stones 1 as a result of the vibrating movement of the support 2 and then drop back onto the surface 1*a* and/or the edges 1*b* again. The lateral and/or horizontal movement of the impact units 4 is restricted essentially to the surface 1*a* of the stones 1 in this context. Lateral stops 9 are provided for this purpose that enclose the impact units 4 in such a way that the lateral and/or horizontal movement of the impact units 4 is restricted essentially to the surface 1*a* of the stones 1.

Figure 4:
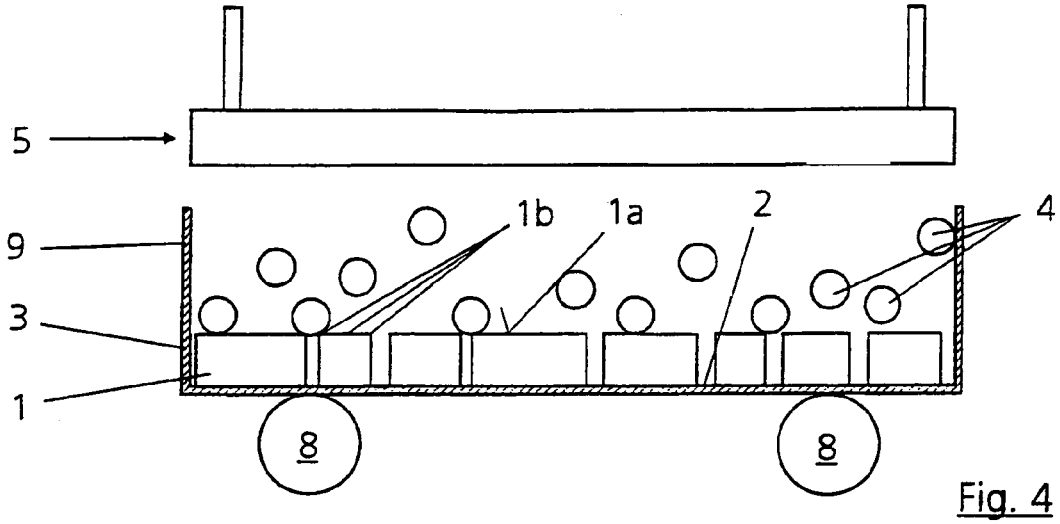
FIG. 4 is a cross section along the line IV—IV in FIG. 3 showing a magnet.

FIG. 4 shows a cross section of the lateral stop 9 for the impact units 4. Like the stop that restricts the lateral and/or horizontal movement of the impact units 4, the rim 3 restricts the lateral and/or horizontal movement of the stones 1 on the support 2. It is provided in this context that the stones 1 can take up positions a distance away from each other that allows the impact units 4 to act on two adjacent edges 1*b* of two stones 1 and/or one stone 1 and the rim 3, without the impact units 4 being able to enter into the gaps created between them completely.

The rim 3 can be configured in such a way in this context that two adjacent stones and/or one stone 1 and the rim 3 are able take up a position with a maximum gap between each other that is smaller than the minimum diameter of the impact units 4 applied to the surface 1*a*.

As can be seen in FIG. 4, for example, it is provided in the embodiment illustrated that the lateral stops 9 take the form of a vertical extension to the rim 3 projecting beyond the surface 1*a* of the stones 1. This means that the support 2 is tray- or pot-shaped.

The ageing process illustrated in FIG. 3 and FIG. 4, i.e. the time during which the impact units 4 act on the surface 1*a* and/or the edges 1*b* of the stones 1, can be 5 to 50 seconds, for example, and amounts preferably to 15 to 30 seconds. Vibration of the support 2 by means of the vibration mechanism 8 is preferably chosen to be carried out in such a way that the impact units 4 are moved with a high amplitude.

In the embodiment illustrated in FIG. 4, in which the impact units 4 are designed to be lifted off the surface magnetically after the surface 1*a* and/or the edges 1*b* of the stones 1 have been processed, a mobile guide can be provided for the magnet 5, so that the impact units 4 can be attracted in a particularly simple way. As can be seen in FIG. 4, the magnet 5 is located above the stones 1 applied to the support 2. Instead of a moving configuration for the magnet 5, it is also possible for the magnetic force of the magnet 5 to be chosen to be so strong that the impact units 4 are lifted off the surface 1*a* and attracted to the magnet 5 without any movement of the magnet 5 too. It is provided in this context that the magnetic force of the magnet 5 can be reduced in such a way to release the stones 1 that the impact units 4 are able to drop back onto the surface 1*a* of the stones 1 under the influence of their own weight and/or gravity.

It is provided in the embodiment illustrated that the number of impact units 4 is chosen in such a way that 30 to 90% and preferably 70% of the surface 1*a* of the stones 1 are covered. In an embodiment that is not illustrated, it can also be provided that the support 2 slopes. It can be provided in this context too that the inclination of the slope of the support 2 is changed constantly, so that the impact units 4 and/or the stones 1 are set in motion additionally.

Configuration of the support 2 to slope can be a suitable way to remove the impact units 4 as well, particularly when they are spherical in shape. A sloping support 2 can be an advantage when the application and removal device 5 is configured in accordance with FIG. 5, if the support 2 slopes downwards towards the collection container 7. In order to be able to remove the impact units 4 from the surface 1*a* of the stones 1 in an advantageous way in accordance with FIG. 5, it can be provided that at least the lateral stop 9 facing the discharge area, i.e. the collection container 7, and/or the relevant extension to the rim 3 can be removed or flapped open. In order to be able to introduce the discharge element 6 as simply as possible, it can also be provided in this context that the opposite lateral stop 9 and/or the relevant vertical extension to the rim 3 can be removed or flapped open. The support 2 can if necessary be provided with a conveyor belt for supplying and/or removing the stones 1.

Figure 6:
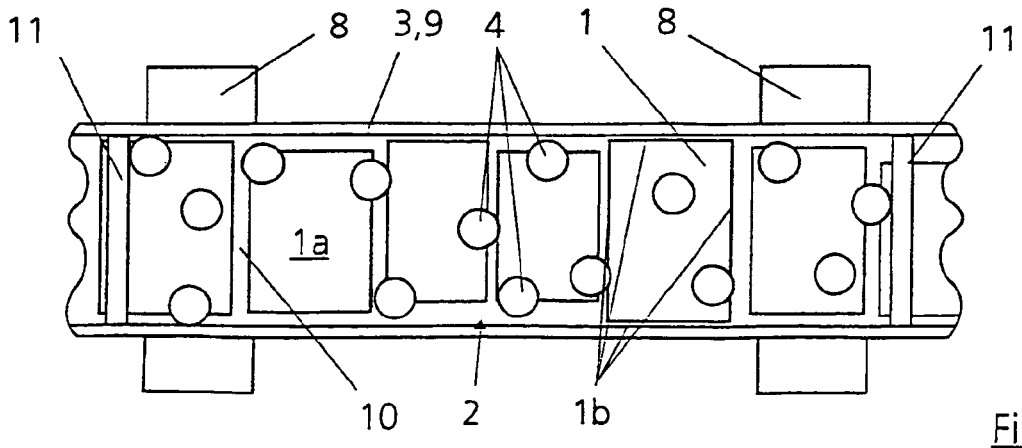
FIG. 6 is a view of a different support with stones arranged in rows, where impact units have been applied to the surface of the stones.

FIG. 6 shows a trough-shaped configuration of the support 2. The use of a conveyor belt 10, on which the stones 1 are placed, is planned in this context. The stones 10 pass through a section provided with impact units 4 in this case. The support 2 is vibrated constantly by the vibration mechanism 8, so that the impact units 4 are constantly being lifted off the surface 1*a* of the stones 1, in order subsequently to drop back onto the surface 1*a* and/or the edge 1*b* again. By choosing an appropriate gap between the stones 1 that pass through and by setting the conveyor belt 10 to move at an appropriate speed, it is simple to arrange for new stones 1 to be supplied constantly that are engaged by the impact units 4 which have been set in motion. It is not therefore necessary to interrupt the ageing process and/or to provide a special application and removal device 5 for the impact units 4.

It is preferable to provide the support 2 with such a slope that the support 2 goes upwards slightly in the direction of movement, thus countering an impulse that the impact units 4 receive by the movement of the stones 1. The section in which the impact units 4 are located can, for example, be limited by a partition wall 11 at the beginning and the end of this section.

The partition wall 11 is preferably designed in such a way in this context that the stones 1 can be transported past underneath it, but that the distance between the partition wall 11 and the surface 1*a* of the stones 1 is not large enough to permit impact units 4 to be transported past underneath the partition wall 11 in addition to the stones 1. It is also preferable for the partition wall 11 to extend vertically in such a way that the impact units 4 cannot be pushed over the partition wall 11. The partition wall 11 can end at the top flush with the lateral stops 9 and/or the vertical extension to the rim 3 in this context.

It is provided in accordance with FIG. 6 that the distance between the individual stones 1 and between the stones 1 and the rim 3 is chosen in such a way that the impact units 4 are able to process the edges 1*b* effectively but that it is not possible for the impact units 4 to enter the gap created by the distance between them completely.

In an alternative to the embodiment in FIG. 6, it can also be provided that several rows of stones 1 are located parallel to each other and pass through the section provided with impact units 4 arranged in this way.

An entire batch of stones 1 can in principle be processed in accordance with FIG. 1 after their production too. It is preferable in this context if complete production batches—similar to the individual stones 1—are transported through a section provided with impact units 4 arranged in rows.

Minor vibration with a low frequency is already adequate to carry out ageing using the solution proposed in the present invention, because the stones 1 can be processed quickly and effectively with the impact units 4, as trials have demonstrated. It is also possible to process the stones 1 in a relatively soft state (i.e. after a brief drying period), because there is no danger of the stones 1 breaking. The apparatus in accordance with the present invention is only worn minimally by processing relatively soft concrete blocks. Short processing times are feasible too. Another advantage is that breakage of the stones 1 cannot be expected, because the cement content of the concrete blocks can be reduced.

The apparatus in accordance with the present invention and/or the process in accordance with the present invention are suitable for ageing any stones and are not limited to concrete stones 1 and/or a specific application. If necessary, the stones 1 can be loaded in the apparatus in accordance with the present invention several times aligned in different ways, so that several edges 1*b* and/or surfaces 1*a* are aged. In the embodiment illustrated, the impact units 4 are able to move completely freely. It can, however, also be provided in accordance with the present invention that the impact units 4 move largely freely, i.e. the impact units 4 could—for example—be linked together so that a kind of network of impact units 4 can be applied to the surface 1*a* of the stones 1. The connection between the impact units 4 could be designed in such a way in this context that a specific movement of the impact units 4 within the network in relation to the other impact units 4 is possible. This means that random engagement of the surface 1*a* by the impact units 4 within a certain range continues to be guaranteed. It could also be provided that the impact units 4 are suspended on flexible wires, ropes, chains etc., so that the impact units 4 can be lowered onto the surface 1*a*. It can be provided in this context that the movement of the impact units 4 is only restricted slightly by the wires and/or ropes on which they are suspended. It can also be provided in this context that the wires allow the impact units 4 to move within a specific radius, so that random engagement of the surface 1*a* of the stones 1 continues to be guaranteed. The application and removal device 5 can be used to remove the impact units, for example. The impact units 4 can be attached to it via the wires and/or ropes. The impact units 4 can be lifted and thus removed from the surface 1*a* by raising the application and removal device 5 and/or by winding up the wires—like pins in a bowling alley.

Various configurations are conceivable in principle that allow the impact units 4 to be arranged to move essentially freely, particularly with respect to the surface 1*a* and/or the edges 1*b* of the stones 1.

The solution in accordance with the present invention is suitable in a particularly advantageous way to age stones with a chip or cracked finish too, which generally have an uneven and/or raised and recessed surface. Due to the uneven nature of their surface, such stones cannot be aged using the state-of-the-art processes. The impact units 4 in accordance with the invention that move freely are, however, suitable for aging the edges and the surface of these stones too.

The invention claimed is:

1. A process for artificially aging stones comprising the following steps:

(a) applying a plurality of stones to a support;

(b) applying a plurality of movable impact units made from hard metal, metal or steel to surfaces of the stones to be processed;

(c) vibrating the support to move the stones and the impact units in relation to each other to cause the impact units to act on the surfaces of the stones and on adjacent, exposed edges of the stones; and (d) using a magnet to attract and lift the impact units from the surfaces after the surfaces or the edges of the stones have been processed.

2. An apparatus for artificially aging stones comprising:

(a) a support for receiving a plurality of stones so as to expose surfaces of the stones to be processed and adjacent edges of the stones;

(b) a plurality of movable impact units for application to the surfaces to be processed and the adjacent edges;

(c) a vibration device for moving the stones and the impact units in relation to each other so that the impact units act on the surfaces and the exposed adjacent edges of the stones; and (d) an application and removal device for applying the movable impact units to the surfaces of the stones and for removing the impact units from the surfaces of the stones, the application and removal device comprising a magnet to attract and lift the impact units in order to remove the impact units from the surfaces of the stones.

3. The apparatus according to claim 2, wherein the magnet is located above the stones loaded on the support.

4. A process for artificially aging stones comprising the following steps:

(a) applying a plurality of stones to a support;

(b) applying a plurality of movable impact units to surfaces of the stones to be processed; and (c) vibrating the support to move the stones and the impact units in relation to each other to cause the impact units to move freely and act on the surfaces of the stones and on adjacent, exposed edges of the stones;

wherein the impact units are caused to undergo lateral or horizontal movement and the lateral or horizontal movement of the impact units is restricted essentially to the surfaces of the stones;

wherein the vibration of the support causes the impact units to bounce on the surfaces of the stones; and wherein the stones are caused to undergo lateral or horizontal movement and the lateral or horizontal movement of the stones applied to the support is restricted.

5. The process according to claim 4, wherein the support has a rim enclosing the stones and the stones are positionable a distance away from each other to form a gap that allows the impact units to act on two adjacent edges of two stones or of one stone and the rim without the impact units being able to completely enter the gap.

6. The process according to claim 4, wherein the vibration of the support has a high amplitude for vibrating the impact units.

7. The process according to claim 4, wherein impact units made from hard metal, metal or steel are used.

8. The process according to claim 4, wherein the impact units are taken away from the surfaces of the stones after the surfaces or the edges of the stones have been processed.

9. The process according to claim 4, wherein the impact units are applied to cover 30 to 90% of the surfaces of the stones.

10. The process according to claim 4, wherein the time during which the impact units act on the surfaces or the edges of the stones amounts to 5 to 50 seconds.

11. An apparatus for artificially aging stones comprising:

(a) a support for receiving a plurality of stones so as to expose surfaces of the stones to be processed and adjacent edges of the stones;

(b) a plurality of movable impact units for application to the surfaces to be processed and the adjacent edges;

(c) a vibration device for moving the stones and the impact units in relation to each other so that the impact units move freely and act on the surfaces and the exposed adjacent edges of the stones; and (d) a rim provided on the support enclosing the stones loaded on the support so that lateral or horizontal movement of the stones is restricted;

wherein the impact units have a minimum diameter and the rim is dimensioned so as to permit positioning of two adjacent stones or one stone relative to the adjacent rim so as to have a maximum distance away from each other that is smaller than the minimum diameter of the impact units applied to the surfaces.

12. The apparatus according to claim 11, wherein the impact units applied to the surfaces of the stones are enclosed by lateral stops that restrict the lateral or horizontal movement of the impact units essentially to the surfaces of the stones.

13. The apparatus according to claim 12, wherein the lateral stops for the impact units are formed by a vertical extension to the rim that projects beyond the surfaces of the stones.

14. The apparatus according to claim 11, wherein the vibration device produces a high amplitude.

15. The apparatus according to claim 11, wherein the impact units are made from hard metal, metal or steel.

16. The apparatus according to claim 11, wherein the impact units have a spherical, annular, polygonal or cylindrical shape.

17. The apparatus according to claim 11, further comprising an application and removal device for applying the movable impact units to the surfaces of the stones and for removing the impact units from the surfaces of the stones.

18. The apparatus according to claim 17, wherein the application and removal device has a discharge element that can be guided over the surfaces of the stones to remove the impact units.

19. The apparatus according to claim 11, wherein the support is provided with a conveyor belt for supplying or removing the stones.

20. The apparatus according to claim 11, wherein the support is dimensioned to hold a freshly-manufactured batch of stones.

21. The apparatus according to claim 11, wherein the support is designed to have the form of a trough.

22. The apparatus according to claim 11, wherein the impact units are applied to cover 30 to 90% of the surfaces of the stones.

* * * * *

Disclaimer

7,128,639 - Thomas Riedle, Aitrach (DE); and Hermann Sauter, Tannheim (DE). PROCESS AND APPARATUS FOR THE ARTIFICIAL AGING OF STONES. Patent dated Oct. 31, 2006. Disclaimer filed May 10, 2010, by the inventors.

Hereby enters this disclaimer to claim all of the claims 1-22 of said patent.

(*Official Gazette, November 23, 2010*)